US006763204B2

(12) United States Patent
Kondo et al.

(10) Patent No.: US 6,763,204 B2
(45) Date of Patent: Jul. 13, 2004

(54) FIXING DEVICE SELECTIVELY OPERABLE IN OPERATING CONTINUOUS POWER TO AN INDUCTION COIL AND OPERATING ON/OFF CONTROL

(75) Inventors: Shunsaku Kondo, Toride (JP); Tomoichirou Ohta, Shimizu (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 10/112,749

(22) Filed: Apr. 2, 2002

(65) Prior Publication Data

US 2002/0146253 A1 Oct. 10, 2002

(30) Foreign Application Priority Data

Apr. 3, 2001 (JP) ..... 2001/105029

(51) Int. Cl.[7] ..... G03G 15/20

(52) U.S. Cl. ..... 399/67; 219/216; 219/619; 399/335

(58) Field of Search ..... 399/69, 67, 336, 399/335; 219/619, 469, 216

(56) References Cited

U.S. PATENT DOCUMENTS 5,179,263 A * 1/1993 Koh et al. ..... 219/216
5,862,436 A * 1/1999 Ishizawa et al. ..... 399/69
5,928,551 A * 7/1999 Okabayashi
5,942,882 A 8/1999 Ohta ..... 323/282
6,072,964 A * 6/2000 Abe et al. ..... 399/69
6,188,054 B1 2/2001 Ohta ..... 219/663
6,292,648 B1 * 9/2001 Higaya et al. ..... 399/335
6,438,335 B1 * 8/2002 Kinouchi et al. ..... 219/619
6,456,818 B1 * 9/2002 Nakayama et al. ..... 219/619
6,496,665 B2 * 12/2002 Umezawa et al. ..... 219/619

* cited by examiner

*Primary Examiner*—Susan S. Y. Lee
(74) *Attorney, Agent, or Firm*—Fitzpatrick, Cella, Harper & Scinto

(57) ABSTRACT

A fixing apparatus includes an induction coil for generating a magnetic field upon electric power supply thereto; a fixing rotatable member for induction heat generation by the magnetic field generated by the induction coil; temperature detector for detecting a temperature of the fixing rotatable member; determining unit for determining an electric power value to be supplied to the induction coil on the basis of a detected temperature by the temperature detector; and a controller for controlling the electric power supply to the induction coil on the basis of the electric power value determined by the determining unit. The controller substantially continues to supply the electric power while the electric power value determined by the determining unit is higher than a predetermined value, and effects an ON/OFF control of rendering on and off the electric power supply when the electric power value is lower than the predetermined value.

12 Claims, 8 Drawing Sheets

FIXING DEVICE SELECTIVELY OPERABLE IN OPERATING CONTINUOUS POWER TO AN INDUCTION COIL AND OPERATING ON/OFF CONTROL

FIELD OF THE INVENTION AND RELATED ART

The present invention relates to a fixing device usable with an image forming apparatus such as a copying machine or a printer using an electrophotographic process, an electrostatic recording process or the like. In conventional image forming apparatuses, a toner image is formed in an image forming station through an indirect (transfer) type or direct type electrophotographic process, electrostatic recording process, magnetic recording process or another known process; and the formed toner image is transferred onto a recording material such as a transfer sheet, recording material, photosensitive paper electrostatic recording paper or the like; and the toner image is fixed on the recording material by a heat fixing device of a heating roller type into a permanent image.

The fixing device or the heating roller type comprises a fixing roller containing therein a heater (heating roller) and a pressing roller press-contacted thereto for form a nip, into which the recording material is introduced and through which the recording material is passed, by which the toner image on the recording material is fixed on the surface of the recording material by heat and pressure.

Recently, the demands with respect to the heat fixing device is (1) high speed start-up and (2) unnecessity for stand-by temperature control, in terms of the convenience and reduction of energy consumption.

In order to accomplish the high speed start-up, it would be considered to reduce the time required for temperature rise up to a desired temperature by reducing the thermal capacity by reducing the thickness of the heat roller, and by using an IH (electromagnetic induction heating type) as a heat source.

A temperature control system in the IH system, it would be considered to use ON-OFF control system which has been used for a temperature control for a halogen lamp (heat source). However, use of the ON-OFF control system with the heat roller having a small thermal capacity results in abrupt temperature changes occurring, and therefore, the proper control is difficult.

Then, a feed-back type is being considered wherein electric power supplied to the heat source used in the IH type system is linearly controlled in accordance with a result of temperature measurement of the fixing device (FIG. 8). In FIG. 8, the FIG. 8 represents an electric power value Po supplied to the heat source, and the abscissa represents a temperature T. When the temperature of the fixing device is Ta, the electric power Pa is supplied to the heat source.

Generally, the relation between the electric power supplied to an induction coil and the electric power efficiency is as shown in FIG. 9 in the IH system. In FIG. 9, the ordinate represents an electric power efficiency $\eta$, and the abscissa represents an electric power Po supplied to the heat source. When the electric power of 200W is supplied to the induction coil, the electric power efficiency is approx. 88%, but when the electric power not more than 200W is supplied, the electric power efficiency is significantly lower than that.

The fixing temperature in the image forming operation is generally not higher than 210° C. When the electric power of 200W is supplied to the coil constituting the IH type voltage source, the temperature may exceed 210° C.

However, if the range not higher than 200W is used, the electric power efficiency is not good, as described above, and therefore, doing so is not advantageous from the standpoint of energy conservation.

SUMMARY OF THE INVENTION

Accordingly, it is a principal object of the present invention to provide a fixing device of an electromagnetic induction heating type wherein the electric power efficiency is high.

It is another object of the present invention to provide a fixing device wherein an electric power value exhibiting a low electric power efficiency is not used.

According to an aspect of the invention, there is provided a fixing apparatus comprising an induction coil for generating a magnetic field upon electric power supply thereto; a fixing rotatable member for induction heat generation by the magnetic field generated by said induction coil; temperature detecting means for detecting a temperature of said fixing rotatable member; determining means for determining an electric power value to be supplied to said induction coil on the basis of a detected temperature by said temperature detecting means; and control means for controlling the electric power supply to said induction coil on the basis of the electric power value determined by said determining means, wherein said control means substantially continues to supply the electric power while the electric power value determined by said determining means is higher than a predetermined value, and effects an ON/OFF control of rendering on and off the electric power supply when the electric power value is lower than the predetermined value.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The embodiments of the present invention will be described in conjunction with the accompanying drawings.

First Embodiment

Figure 1:
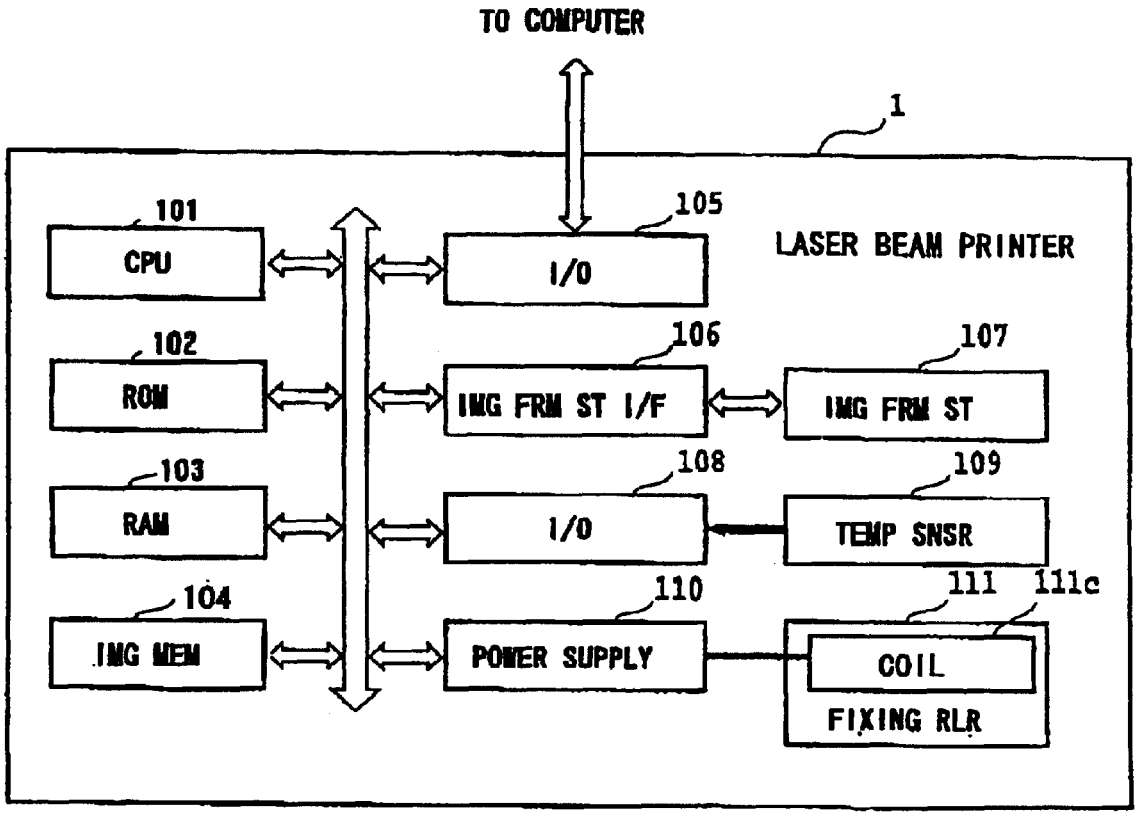
FIG. 1 is a block diagram illustrating a device of a first embodiment of the present invention.

FIG. 1 is a flow chart of a system according to a first embodiment of the present invention. In this embodiment, the apparatus is a laser beam printer 1 using an image transfer type electrophotographic process. In the laser beam printer 1, there are provided a CPU101, a ROM 102, a RAM 103, an image memory 104, an input/output portion 105, an image formation station interface 106, an input/output portion 108 and an electric power supply portion 110 which are mutually connected through a system bus.

The ROM 102 stores a control program and the like. The CPU101 controls various parts of the laser beam printer 1 in accordance with the control program stored in the ROM 102. The RAM 103 is used as a work area of the CPU101.

The input/output portion 105 converts the PDL (page description language) inputted from the computer to bit map data. The image memory 104 functions to stores the processed image data. The image formation station 107 is connected to an image formation station I/F, and functions to forms a latent image in accordance with the image data, and develop the latent image, and then, transfers toner image provided by the development onto the recording material.

The electric power supply portion 110 functions to supply a high oscillation current from a high oscillation switching voltage source of 10 kHz–100 kHz to an induction coil 111*c* for induction beating of the fixing roller 111. The electric power supply portion 110 is supplied with an electric power value setting signal and an electric power supply ON/OFF from the CPU101. The temperature sensor 109 is effective to detect the temperature of the fixing roller 111. The input/output portion 108 is connected with a temperature sensor 109.

Figure 2:
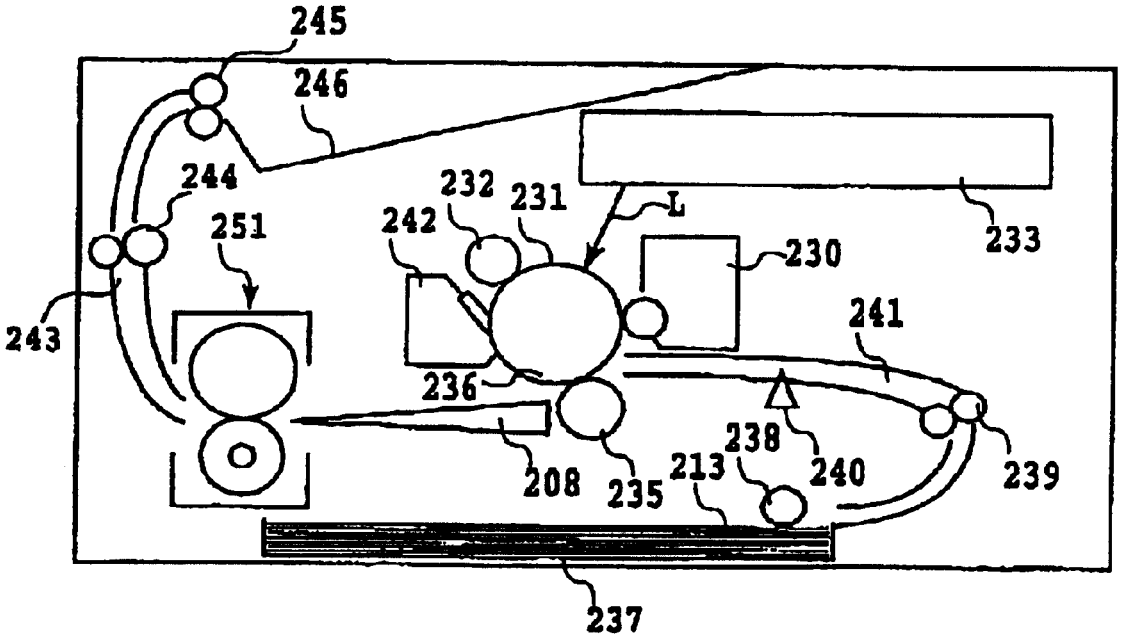
FIG. 2 is a sectional view illustrating a structure of a laser beam printer shown in FIG. 1.

FIG. 2 illustrate a structure of a laser beam printer 1 of FIG. 1. In FIG. 2, designated by 231 is an electrophotographic photosensitive member in the form of a rotatable drum, as is rotated in a direction indicated by an arrow in FIG. 2 at a peripheral speed (process speed). Designated by 232 is a charging roller for electrically charging the electrophotographic photosensitive member 231 to a predetermined potential in a predetermined polarity. Designated by 232 is a laser scanner which functions to effect laser beam scanning exposure L of the electrophotographic photosensitive member 231 corresponding to the image information pattern. By the scanning exposure, an electrostatic latent image is formed on the surface of the electrophotographic photosensitive member 231 in accordance with the intended image information pattern.

Reference numeral 234 designates a developing device functioning to develop the electrostatic latent image on the surface of the electrophotographic photosensitive member 231. By the developing operation, the toner image is formed on the surface of the electrophotographic photosensitive member 231. The developing method may be a jumping developing method, two component developing method or the like in combination of an image exposure and a reverse development.

Designated by 235 is a transfer roller which forms a transfer nip 236 between the electrophotographic photosensitive member 231. The recording material (transfer material) is fed into the nip at a predetermined timing from a sheet feeder 37 so that toner image is transferred from the surface of the electrophotographic photosensitive member 231 thereonto. The recording material 213 now having the transferred toner image is separated from the surface of the electrophotographic photosensitive member 231 and is fed into the fixing device 251 by way of the feeding guide 8. The fixing device 251 functions to fix the toner image on the recording material 213 by heat and pressure.

Designated by 244 is a pair of feeding rollers provided to feed the recording material 213 on which the image has been fixed, to the sheet discharging path 243 from the fixing device 251. Reference numeral 245 designates a pair of discharging roller which functions to discharge the recording material 213 fed by the feeding rollers onto a sheet discharge tray 246.

Reference numeral 237 designates a sheet feeding cassette for accommodating the recording material 213. Reference numeral 238 designates a sheet feeding roller 238 cooperating with an unshown separating member (singling out) to separate one by one the recording materials 213 from the sheet feeding cassette 237. Reference numeral 239 designates a pair of feeding rollers which functions to feed the recording material 213 separated from the sheet feeding cassette 237 into the transfer nip 236 through a sheet path 241 at a predetermined control timing.

Designated by 240 is a top sensor provided in the sheet path 241 to detect the leading end of the recording material 213.

Reference numeral 242 designates a cleaner functioning to remove deposited contamination suchh as untransferred toner, paper dust or the like remaining on the surface of the electrophotographic photosensitive member 231 after the image transfer. The electrophotographic photosensitive member 231 having been subjected to the surface cleaning operation is repeatedly used for the image formation.

Figure 3:
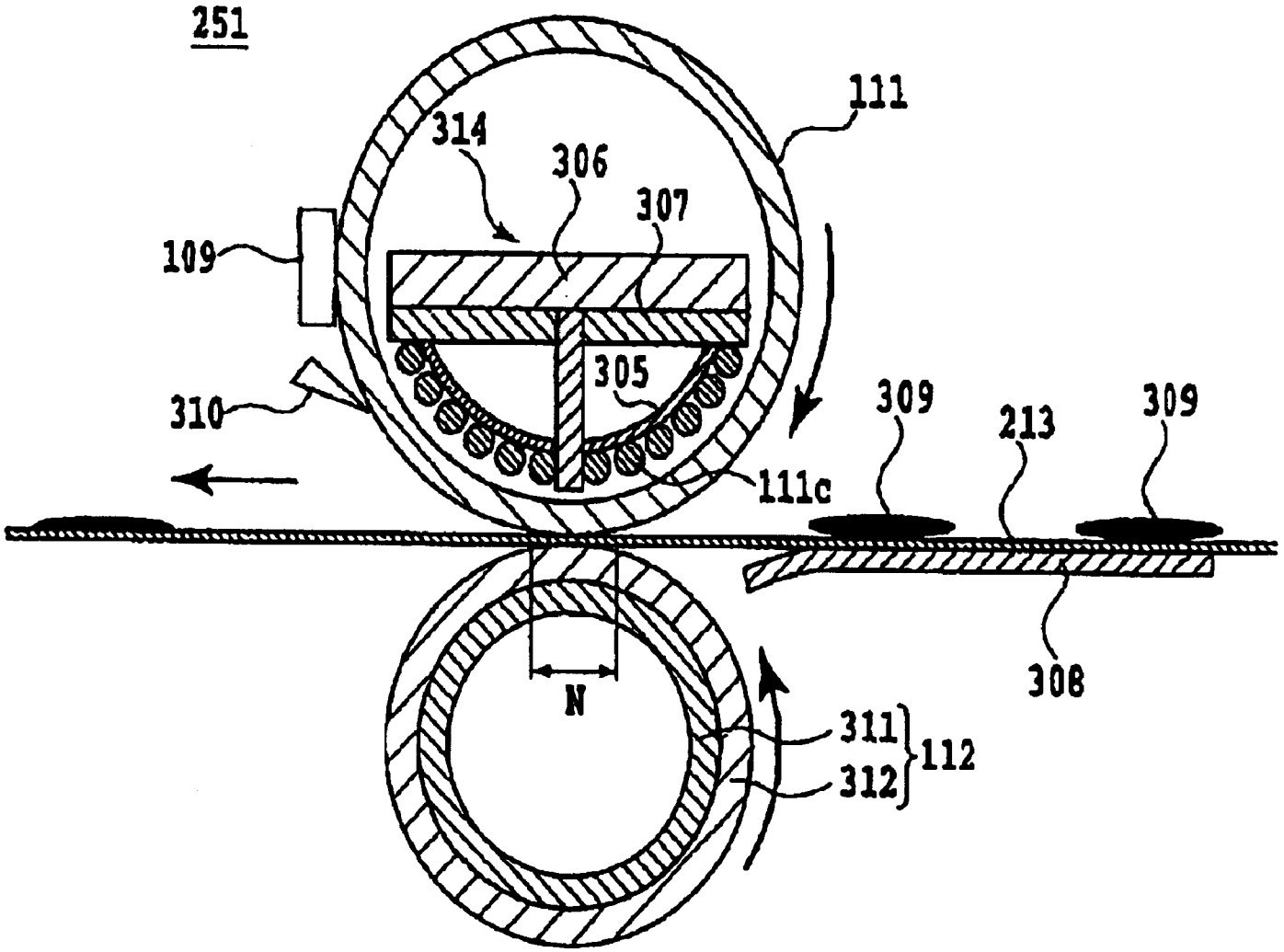
FIG. 3 is a sectional view showing a structure of a fixing device 251 of FIG. 2.

FIG. 3 shows a structure of the fixing device 251 shown in FIG. 2. In FIG. 3, reference numerals 109, 111, 111*c* designate the same elements as with FIG. 1. The fixing device 251 includes a fixing roller 111 and a pressing roller 112 which are arranged substantially vertically, and arc press-contacted to each other. The pressing roller 112 is press-contacted with a predetermined pressure to a lower surface portion of the fixing roller 111 by an unshown pressing mechanism including a spring applying a spring force to a rotational axis of the fixing roller 111, by which a fixing nip (press-contact nip) N is formed. The pressing roller 112 is urged by approx. 30 kg, and the fixing nip N has a width or approx. 6 mm. The urging force is variable to change the width of the nip.

When the fixing roller 111 is rotated, the pressing roller 112 is driven by the fixing roller 111 because of a frictional force at the fixing nip N with the rotational driving of the fixing roller 111.

The fixing roller 111 includes a surface parting layer (electroconductive cylindrical roller) as a base and a surface parting layer. The core metal cylinder is made of steel having an electroconductivity and having an outer diameter of 40 mm and a thickness of 0.7 mm. The surface parting layer is provided to enhance a parting property of the surface of the core metal cylinder, and an example of which is a PTFE (polytetrafluoroethylene) or PFA (perfluoroslkoxy) or the like layer having a thickness of 10–50 $\mu$m. In order to improve the fixing property and to reduce the surface temperature non-uniformity of the fixing roller 111, an elastic layer of silicone rubber having a thickness of 20–500 $\mu$m, for example, may be provided between the core metal cylinder and the surface parting layer.

In the space in the core metal cylinder, there is provided an induction coil assembly 314 which comprises an induction coil 111*c*, a coil holder 305, a core (core of the magnet) 307 and a stay 306.

The coil holder 305 is in the form of a semicircular trough of heat resistive resin material such as PPS (polyphenylenesulfide), PEEK (polyethelethelketon), phenolic resin. The induction coil 111*c* is formed by 6 turns of Litz wire of 50–150 twisted yarns. The number of winding is not limited to 6, but may be 4–10 turns. The induction coil 111*c* is placed face down adjacent to the inner surface of the core metal cylinder, and the opposite end portions of the stay 306 is fixed between unshown fixing unit frames. The core 307 is provided inside the coil holder 5 in the form having a T-shaped cross-section, and is made integral into the induction coil assembly 314.

The induction coil 111*c* generates alternating magnetic flux by a high frequency AC current supplied from the electric power supply portion 110 (FIG. 1), the magnetic field induced by the AC current generates eddy currents in the thickness of the core metal cylinder to produce joule heat which heats the fixing roller 111 to raise the temperature of the fixing roller 111.

The pressing roller 112 comprises a hollow core metal 311 and a surface parting property heat resistive rubber layer formed on the outer surface thereof or an elastic layer 312 which is a sponge layer functioning also as a heat insulation layer between the hollow core metal 311 and the surface.

Designated by 310 is a separation claw for separating the recording material having passed through the fixing nip N.

The heat generation in the fixing roller 111 may be increased by increasing the number of windings of the induction coil 111*c*, using, for the core 307, ferrite, permalloy or the like having a high magnetic permeability and a low remanent magnetic flux density, or by raising the frequency of the AC current.

Figure 4:
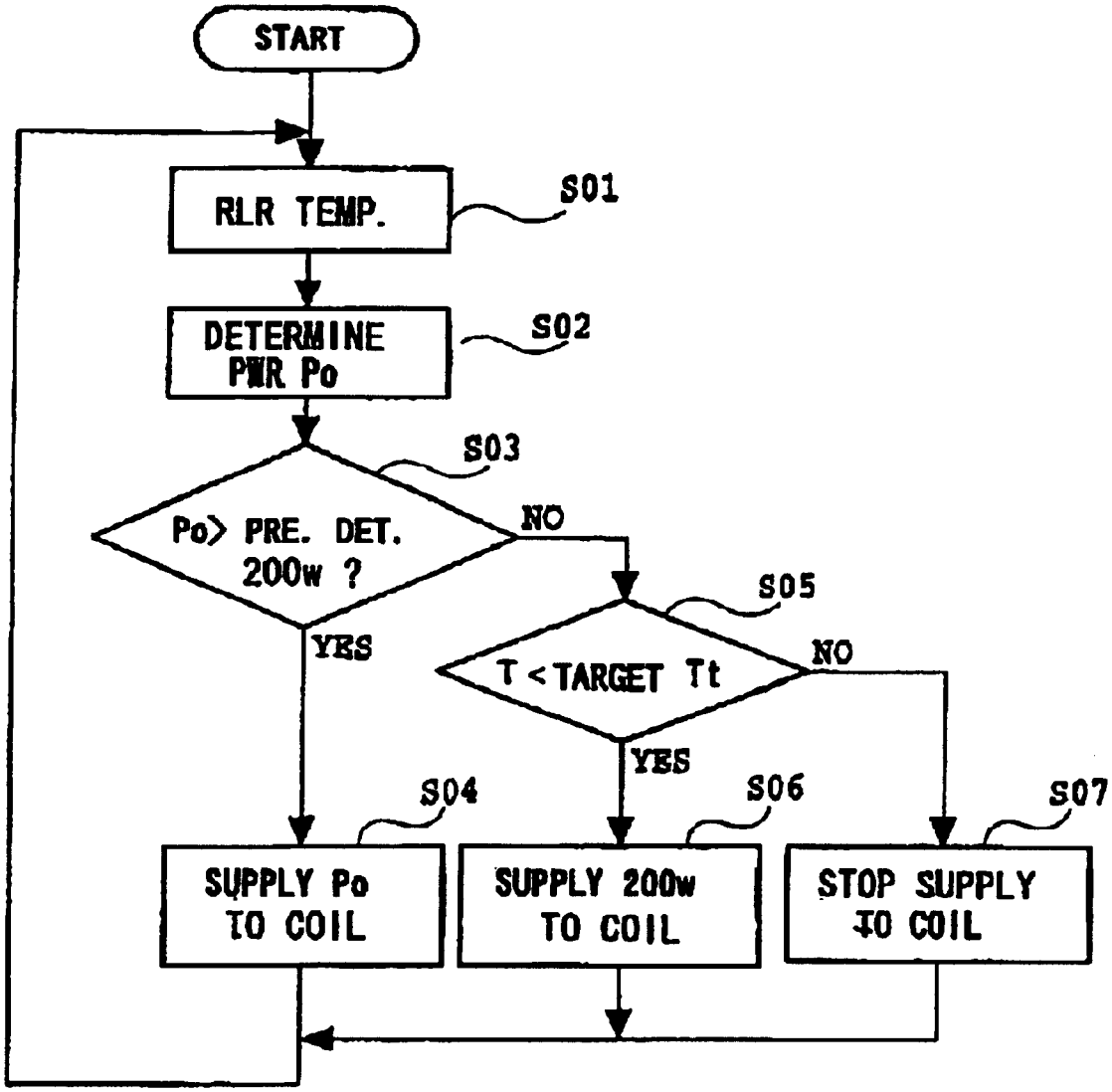
FIG. 4 is a flow chart showing an example of a control program stored in a ROM 103 shown in FIG. 1 in the first embodiment.

FIG. 4 is a flow chart showing an example of a control program stored in the RAM 103 shown in FIG. 1. The fixing device 251 is set such that fixing target temperature Tt is exceeded when the induction coil 111*c* is continuously supplied with an electric power of 200W which is 88% of the power at which the electric power efficiency abruptly lowers.

The surface temperature of the fixing roller 111 (roller temperature T) is roller temperature T is measured by the temperature sensor 109 (S01), and an electric power value Po of the electric power to be supplied to the induction coil 111*c* is determined on the basis or the temperature detected by the temperature sensor 109 (S02). The comparison is made between the electric power value Po to be supplied to the induction coil 111*c* and a predetermined electric power value which is 200W in this embodiment (S03). If the electric power value Po is larger than 200W, the electric power of Po continues to be supplied without shutting the electric power supply to the induction coil 111*c* from the electric power supply portion 110 (S04). Thereafter, the operation returns to the step S01, and the same steps are repeated.

On the other hand, the electric power value Po determined at the step S02 is not higher than 200W (S03), the comparison is further made between the roller temperature T detected by the temperature sensor 109 and the target temperature Tt. When the roller temperature T is not higher than the target temperature Tt, the electric power of 200W is supplied to the induction coil 111*c* from the electric power supply portion 110 (S06). Then, the operation returns to S01.

On the other hand, when the roller temperature T is not lower than the target temperature Tt (S05), the electric power supply from the electric power supply portion 110 to the induction coil 111*c* is stopped (S07). Then, the operation returns to S01.

Figure 5:
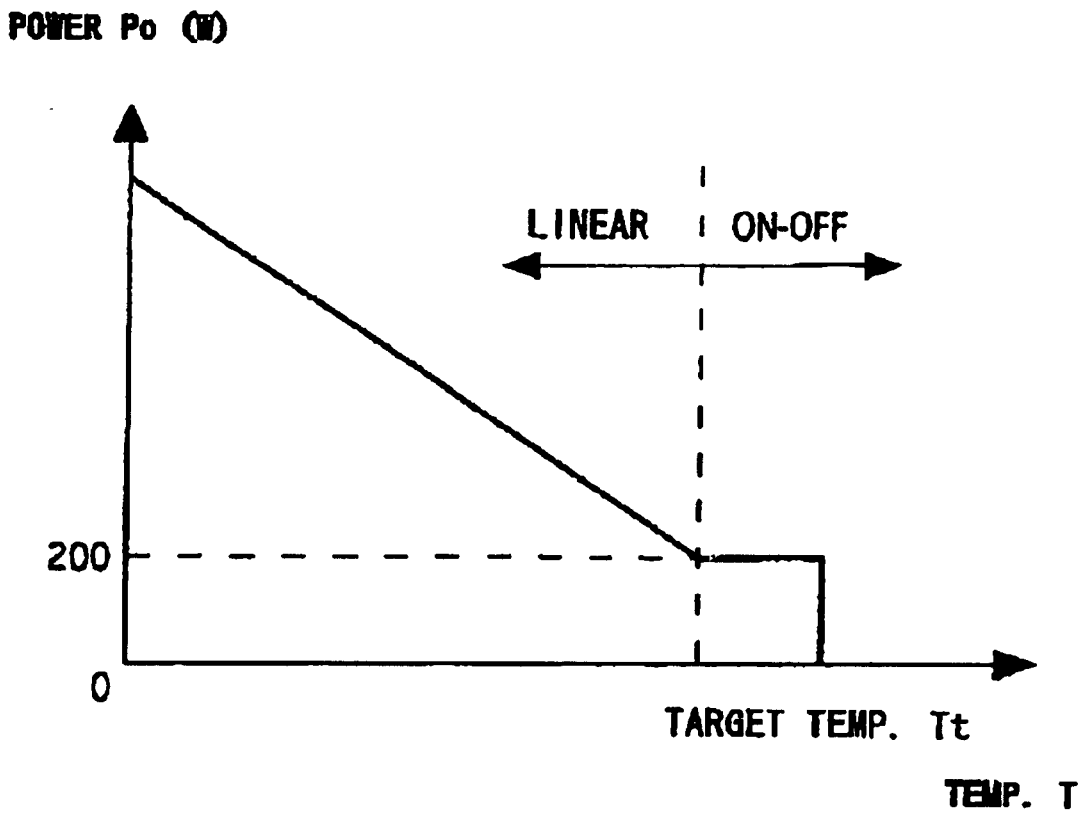
FIG. 5 is a graph of a relation between the temperature and the electric power supply, showing an example or switching of the control mode.

By the temperature control for the fixing roller 111 described in the foregoing, when the electric power to be supplied to the induction coil 111*c* is not lower than 200W, a linear control in which the electric power determined on the basis of the roller temperature T is supplied, and when it is necessary to supply the electric power not more than 200W, the electric power supply of 200W is on-off-controlled. In this manner, the temperature control does not use the electric power value not more than 200W which leads to a low electric power efficiency. FIG. 5 shows an example of a relation between the temperature and the electric power supply and an example of switching of control mode.

Second Embodiment

This embodiment is different from the first embodiment in the temperature control method for the fixing roller 111.

Figure 6:
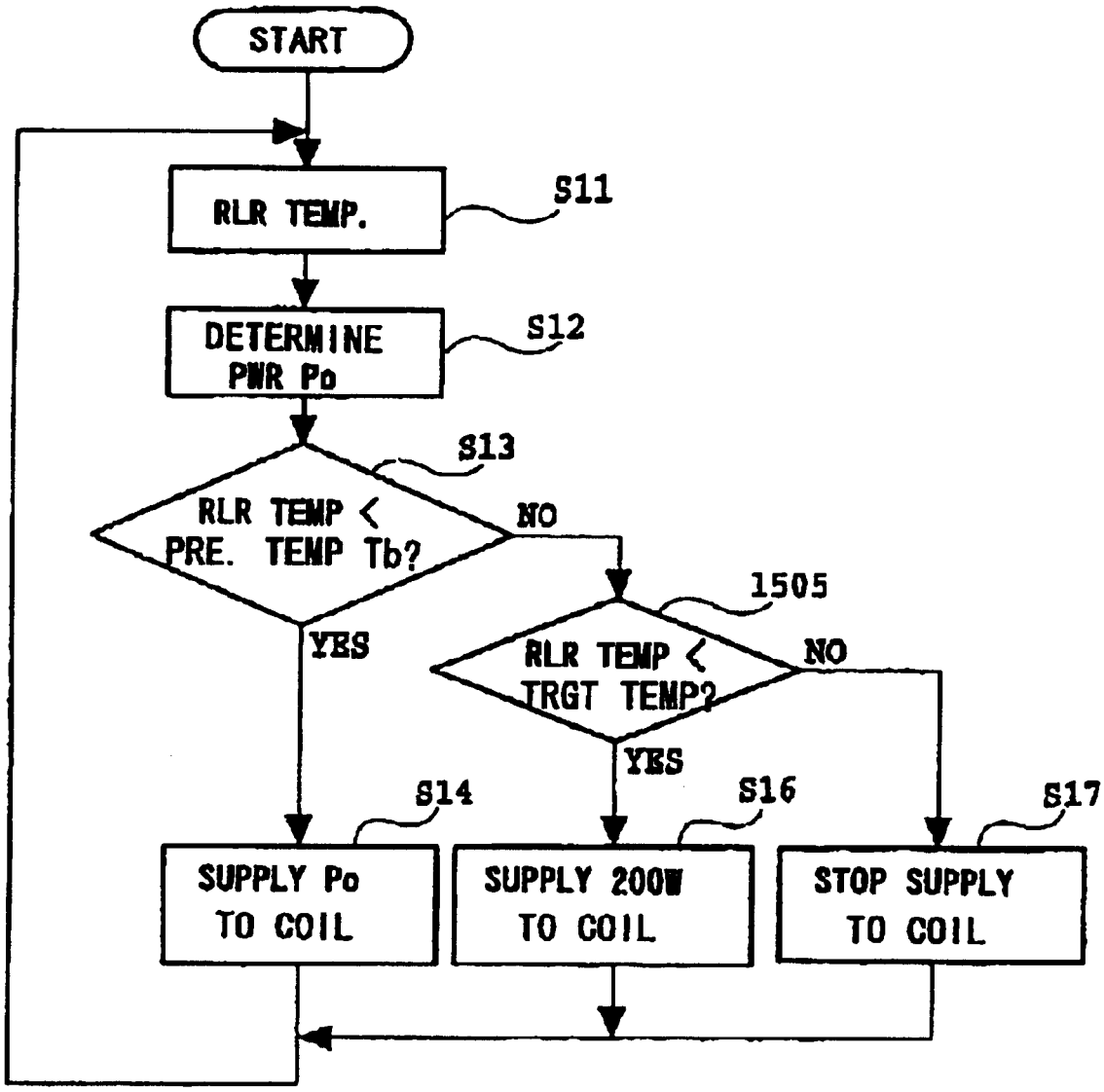
FIG. 6 is a flow chart showing an example of a control program stored in a ROM 103 shown in FIG. 1 in the second embodiment.

FIG. 6 is a flow chart showing an example of a control program stored in a ROM 103 shown in FIG. 1 in the second embodiment. By the temperature sensor 109, the surface temperature of the fixing roller 111 (roller temperature T) is measured (S11), and the electric power value Po to be supplied to the induction coil 111*c* is determined on the basis of the temperature detected by the temperature sensor 109 (S12). The detected roller temperature T is compared with a predetermined temperature value Tb which is lower than the target temperature Tt (S13).

When the roller temperature T is lower than the predetermined temperature value Tb, the electric power of electric power value Po is supplied to the induction coil 111*c* from the electric power supply portion 110 (S14).

Figure 7:
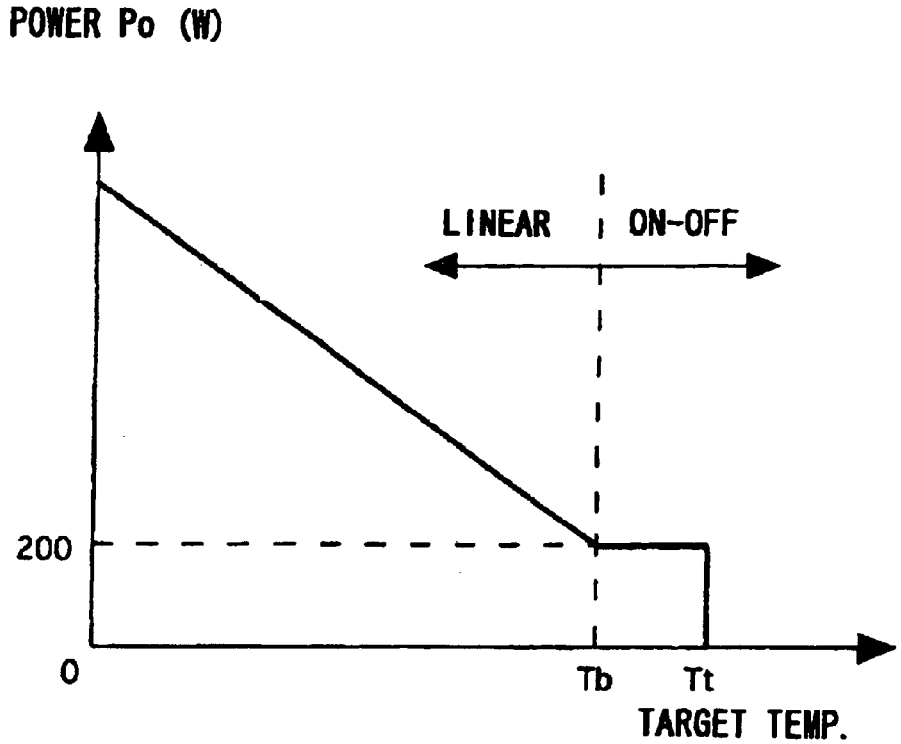
FIG. 7 is a graph of a relation between the temperature and the electric power supply, showing an example of switching of the control mode.
Figure 8:
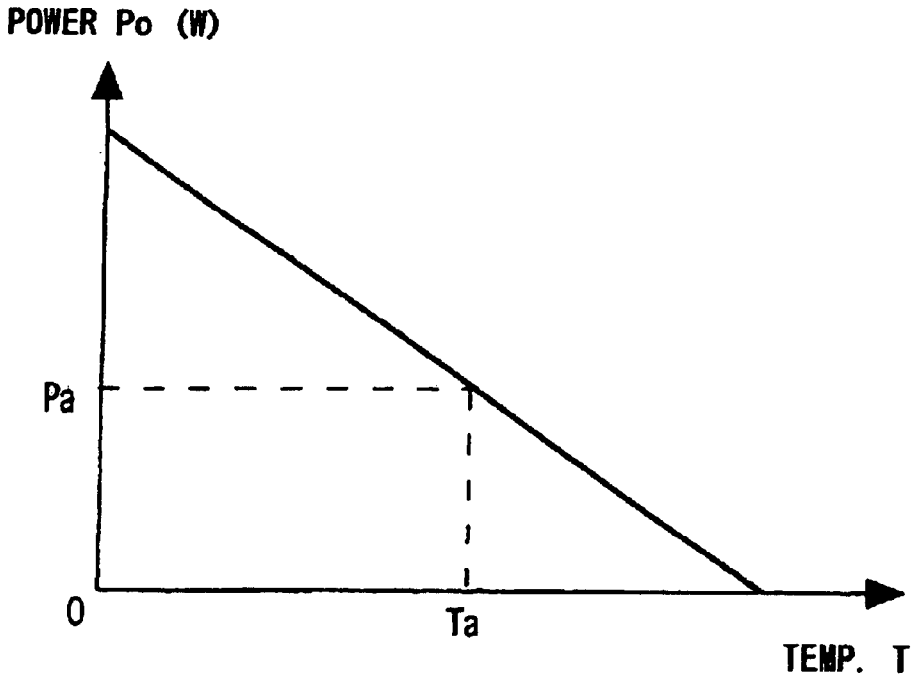
FIG. 8 PRIOR ART
FIG. 8 is a graph of a relation between the temperature and the electric power supply in a conventional temperature control.
Figure 9:
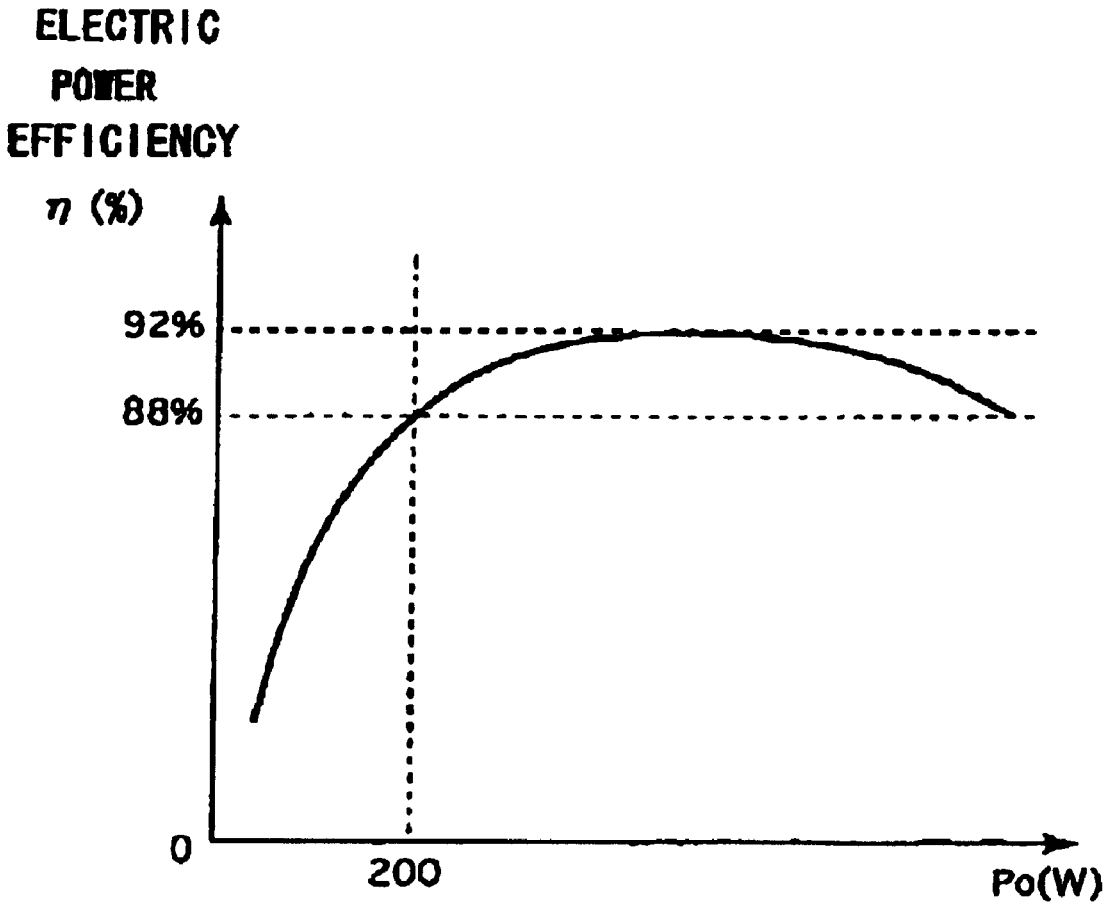
FIG. 9 is a graph of an example of a relation between the electric power supplied to the induction coil and the electric power efficiency.

On the other hand, when the roller temperature T is not lower than the predetermined temperature Tb, the comparison is made between the target temperature Tt and the roller temperature T (S15). When the roller temperature T is not lower than the target temperature Tt, the electric power supply from the electric power supply portion 110 to the induction coil 111*c* is stopped (S17). On the other hand, when the roller temperature T is lower than the target temperature Tt, the electric power of 200W is supplied to the induction coil 111*c*. FIG. 7 shows an example of a relation between the temperature and the electric power supply and an example of switching of control mode.

The present invention is applicable to a system comprising a plurality of piece of equipment, or to an apparatus of a single equipment.

The present invention is implemented by a computer (or CPU or MPU) reading and executing the program code stored in a memory medium which stores the program code of software for executing the function of any one of the foregoing embodiments. During the linear control mode operation, a phase control or wave number control may be carried out to provide the determined electric power. Kimari2

While the invention has been described with reference to the structures disclosed herein, it is not confined to the details set forth and this application is intended to cover such modifications or changes as may come within the purpose of the improvements or the scope of the following claims.

What is claimed is:

1. A fixing apparatus comprising:

an induction coil for generating a magnetic field upon electric power supply thereto;

a fixing rotatable member for induction heat generation by the magnetic field generated by said induction coil;

temperature detecting means for detecting a temperature of said fixing rotatable member;

determining means for determining an electric power value to be supplied to said induction coil on the basis of a detected temperature by said temperature detecting means; and control means for controlling the electric power supply to said induction coil on the basis of the electric power value determined by said determining means, wherein said control means substantially continues to supply the electric power while the electric power value determined by said determining means is higher than a predetermined value, and effects an ON/OFF control of rendering on and off the electric power supply when the electric power value is lower than the predetermined value.

2. An apparatus according to claim 1, wherein the ON/OFF control is effected with a predetermined electric power level.

3. An apparatus according to claim 1, wherein said determining means determines an electric power value on the basis of a predetermined table.

4. An apparatus according to claim 3, wherein said table is based on a linear expression.

5. An apparatus according to claim 1, wherein said ON/OFF control includes the electric power supply and non-electric-power-supply on the basis of whether the detected temperature by said temperature detecting means is higher or lower than a target temperature.

6. An apparatus according to claim 1, wherein said determining means determines the electric power value such that when the detected temperature by said temperature detecting means is high, the electric power value is low.

7. A fixing apparatus comprising:

an induction coil for generating a magnetic field upon electric power supply thereto;

a fixing rotatable member for induction heat generation by the magnetic field generated by said induction coil;

temperature detecting means for detecting a temperature of said fixing rotatable member;

determining means for determining an electric power value to be supplied to said induction coil on the basis of a detected temperature by said temperature detecting means; and control means for controlling the electric power supply to said induction coil on the basis of the electric power value determined by said determining means, wherein said control means substantially continues to supply the electric power while the electric power value determined by said determining means is lower than a predetermined value, and effects an ON/OFF control of rendering on and off the electric power supply when the electric power value is higher than the predetermined value.

8. An apparatus according to claim 7, wherein the ON/OFF control is effected with a predetermined electric power value.

9. An apparatus according to claim 7, wherein said determining means determines an electric power value on the basis of a predetermined table.

10. An apparatus according to claim 9, wherein said table is based on a linear expression.

11. An apparatus according to claim 7, wherein said ON/OFF control includes the electric power supply and non-electric-power-supply on the basis of whether the detected temperature by said temperature detecting means is higher or lower than a target temperature.

12. An apparatus according to claim 7, wherein said determining means determines the electric power value such that when the detected temperature by said temperature detecting means is high, the electric power value is low.

* * * * *

UNITED STATES PATENT AND TRADEMARK OFFICE

CERTIFICATE OF CORRECTION

PATENT NO. : 6,763,204 B2
DATED : July 13, 2004
INVENTOR(S) : Shunsaku Kondo et al.

It is certified that error appears in the above-identified patent and that said Letters Patent is hereby corrected as shown below:

Column 1,
Line 23, “or” should read -- of --.
Line 25, “for” should read -- to --.
Line 39, “A” should read -- As a --.

Column 3,
Line 17, “stores” should read -- store --.
Line 20, “forms” should read -- form --.
Line 33, “illustrate” should read -- illustrates --.

Column 4,
Line 6, “roller” should read -- rollers --.
Line 11, “238” (2nd occurrence) should be deleted.
Line 23, “suchh” should read -- such --.
Line 33, “arc” should read -- are --.
Line 54, “PFA (perfluoroslkoxy)” should read -- PFA (perfluoroalkoxy) --.

Column 5,
Line 7, “coil holder 5” should read -- coil holder 305 --.

Column 6,
Line 44, “piece” should read -- pieces --.

Signed and Sealed this

Eighth Day of February, 2005

JON W. DUDAS
*Director of the United States Patent and Trademark Office*